US009249774B2

(12) United States Patent
Huberts et al.

(10) Patent No.: US 9,249,774 B2
(45) Date of Patent: Feb. 2, 2016

(54) SPARK PLUG FOULING DETECTION FOR IGNITION SYSTEM

(71) Applicant: Ford Global Technologies, LLC, Dearborn, MI (US)

(72) Inventors: Garlan J. Huberts, Milford, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 283 days.

(21) Appl. No.: 14/077,064

(22) Filed: Nov. 11, 2013

(65) Prior Publication Data

US 2015/0112573 A1 Apr. 23, 2015

Related U.S. Application Data

(60) Provisional application No. 61/892,068, filed on Oct. 17, 2013.

(51) Int. Cl.
*F02P 9/00* (2006.01)
*F02P 17/12* (2006.01)
*F02P 3/045* (2006.01)

(52) U.S. Cl.
CPC ..... *F02P 17/12* (2013.01); *F02P 3/0453* (2013.01)

(58) Field of Classification Search
CPC ..... F02P 3/01; F02P 3/05; F02P 9/002; H01F 38/12
USPC ..... 123/606, 609, 620, 634, 179.5
See application file for complete search history.

(56) References Cited

U.S. PATENT DOCUMENTS 4,711,226 A * 12/1987 Neuhalfen ..... F02P 3/0456 123/609
4,750,467 A * 6/1988 Neuhalfen ..... F02P 3/0456 123/611
5,758,629 A * 6/1998 Bahr ..... F02P 3/0456 123/644
6,142,130 A * 11/2000 Ward ..... F02P 3/005 123/606
2013/0206106 A1 8/2013 Huberts et al.

* cited by examiner

*Primary Examiner* — John Kwon
(74) *Attorney, Agent, or Firm* — Julia Voutyras; Alleman Hall McCoy Russell & Tuttle LLP

(57) ABSTRACT

A method for determining a level of spark plug fouling and providing an indication to change the spark plugs of an ignition system is provided. The method includes providing a dwell command on a control wire of an ignition system and generating an indication of a recommendation to change a spark plug of the ignition system based upon a current on the control wire.

8 Claims, 4 Drawing Sheets

SPARK PLUG FOULING DETECTION FOR IGNITION SYSTEM

CROSS REFERENCE TO RELATED APPLICATIONS

The present application is a non-provisional of and claims priority to U.S. Provisional Patent Application No. 61/892,068, entitled "SPARK PLUG FOULING DETECTION FOR IGNITION SYSTEM," filed on Oct. 17, 2013, the entire contents of which are hereby incorporated by reference for all purposes.

FIELD

The present disclosure relates to an ignition system for detecting spark plug fouling and pre-ignition.

BACKGROUND AND SUMMARY

Spark plug fouling and pre-ignition caused by hot spark plugs is a significant issue in areas with poor fuel quality control. Fuel additives such as MMT or ferrocene may build up electrically conductive and thermally insulating deposits on the spark plug ceramic. Such build up may cause misfires or pre-ignition (PI). Due to the potential severity of misfires or PI at high speed and load in boosted engines, vehicle manufacturers may recommend very short spark plug change intervals. However, as the issue of misfires and PI due to fuel additive build up is often a geographically and seasonally limited issue, such frequent spark plug changes may be unnecessary for some vehicles.

The inventors have recognized the above issues, and offer a system to at least partly address said issues. In particular, the present disclosure provides low cost and easy-to-implement methods and systems for continuously detecting the fouling level present at the spark plug, detecting the occurrence of PI and warning the customer to change plugs only when conditions warrant. In one embodiment, a method includes providing a dwell command on a control wire of an ignition system and generating an indication of a recommendation to change a spark plug of the ignition system based upon a current on the control wire.

The present disclosure may offer several advantages. For example, by providing spark plug change recommendations based on evidence of malfunction or degradation, rather than a predetermined period of time or amount of vehicle usage, such recommendations may ensure that spark plug change recommendations are provided in a timely manner. The recommendations supported by measured indications of spark plug fouling may ensure that spark plug change recommendations are not provided too soon, resulting in increased cost for the driver, or too late, resulting in damage to the vehicle.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

An ignition system for detecting spark plug fouling and pre-ignition is disclosed herein. The spark plug fouling and pre-ignition detection enables spark plug change recommendations to be provided based on evidence of malfunction or degradation, rather than a predetermined period of time or amount of vehicle usage (e.g., recorded operational mileage, number of combustion cycles, etc.). By measuring voltage at a terminal of the secondary windings of the ignition coil opposite of the spark plug, the level of impedance of the spark plug (indicating a level of fouling) may be determined and utilized to provide spark plug change recommendations.

Figure 1:
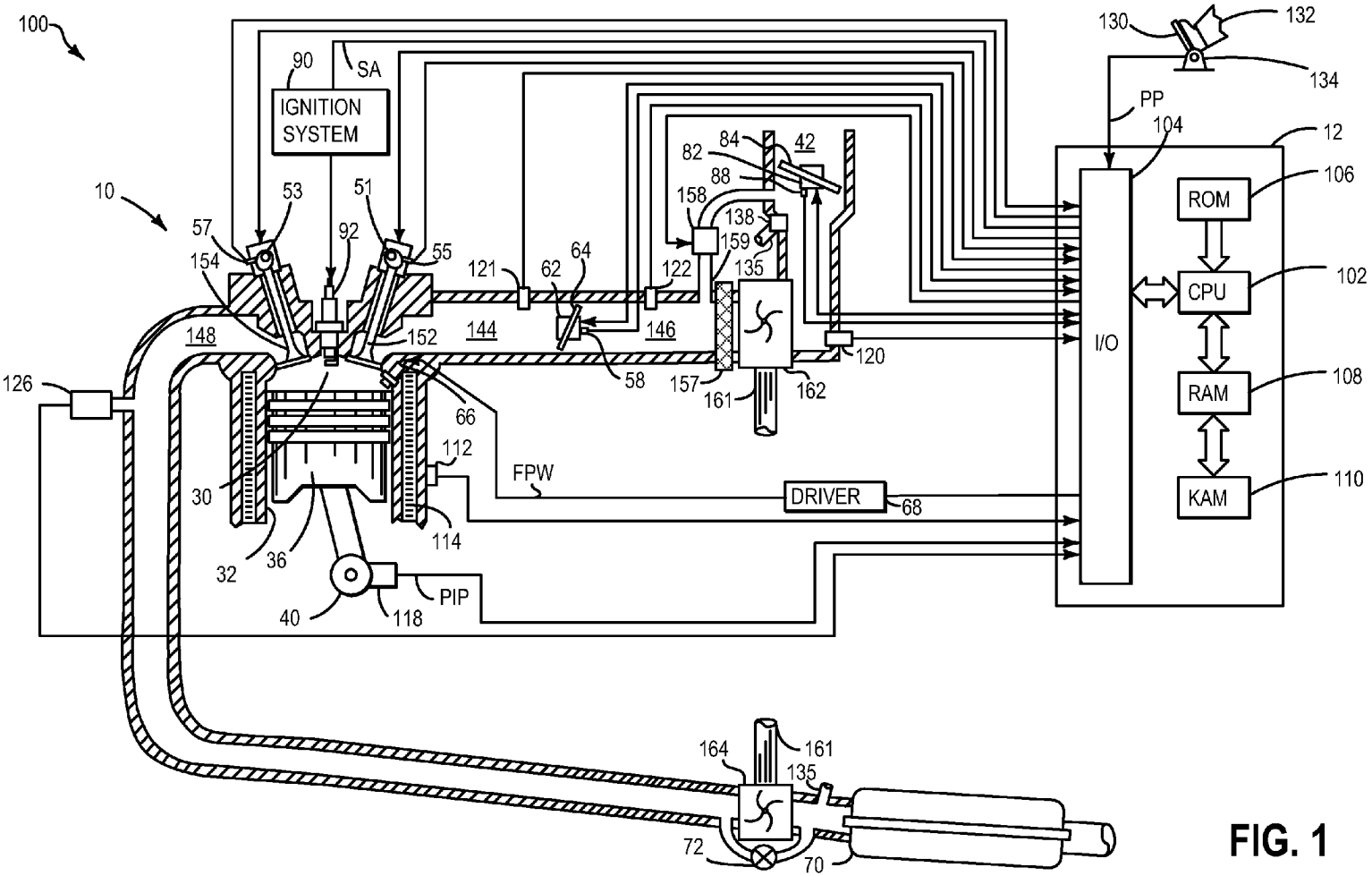
FIG. 1 is a schematic diagram of an engine.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12. Engine 10 includes combustion chamber 30 and cylinder walls 32 with piston 36 positioned therein and connected to crankshaft 40. Combustion chamber 30 is shown communicating with intake manifold 144 and exhaust manifold 148 via respective intake valve 152 and exhaust valve 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In addition, intake manifold 144 is shown communicating with optional electronic throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the boost chamber 146.

In some embodiments, engine 10 is configured to provide exhaust gas recirculation, or EGR. When included, EGR is provided via EGR passage 135 and EGR valve 138 to the engine air intake system at a position downstream of air intake system (AIS) throttle 82 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Compressor 162 draws air from air intake passage 42 to supply boost chamber 146. In some examples, air intake passage 42 may include an air box (not shown) with a filter. Exhaust gases spin turbine 164 which is coupled to compressor 162 via shaft 161. A vacuum operated wastegate actuator 72 allows exhaust gases to bypass turbine 164 so that boost pressure can be controlled under varying operating conditions. In alternate embodiments, the wastegate actuator may be pressure or electrically actuated. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in passage 146, downstream of compressor 162, for cooling the boosted aircharge delivered to the engine intake. In the depicted example, compressor recirculation path 159 is configured to recirculate cooled compressed air from downstream of charge air cooler 157 to the compressor inlet. In alternate examples, compressor recirculation path 159 may be configured to recirculate compressed air from downstream of the compressor and upstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Distributorless ignition system 90 provides an ignition spark to combustion chamber 30 via spark plug 92 in response to controller 12. The ignition system 90 may include an induction coil ignition system, in which an ignition coil transformer is connected to each spark plug of the engine. An example ignition system that may be utilized in the engine of FIG. 1 is described in more detail below with respect to FIG. 2. Universal Exhaust Gas Oxygen (UEGO) sensor 126 is shown coupled to exhaust manifold 148 upstream of catalytic converter 70. Alternatively, a two-state exhaust gas oxygen sensor may be substituted for UEGO sensor 126. Converter 70 can include multiple catalyst bricks, in one example. In another example, multiple emission control devices, each with multiple bricks, can be used. Converter 70 can be a three-way type catalyst in one example. While the depicted example shows UEGO sensor 126 upstream of turbine 164, it will be appreciated that in alternate embodiments, UEGO sensor may be positioned in the exhaust manifold downstream of turbine 164 and upstream of convertor 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator pedal position (PP) adjusted by a foot 132 of a vehicle operator; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 30 via intake manifold 144, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 152 and exhaust valve 154 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is described merely as an example, and that intake and exhaust valve opening and/or closing timings may vary, such as to provide positive or negative valve overlap, late intake valve closing, or various other examples.

Figure 2:
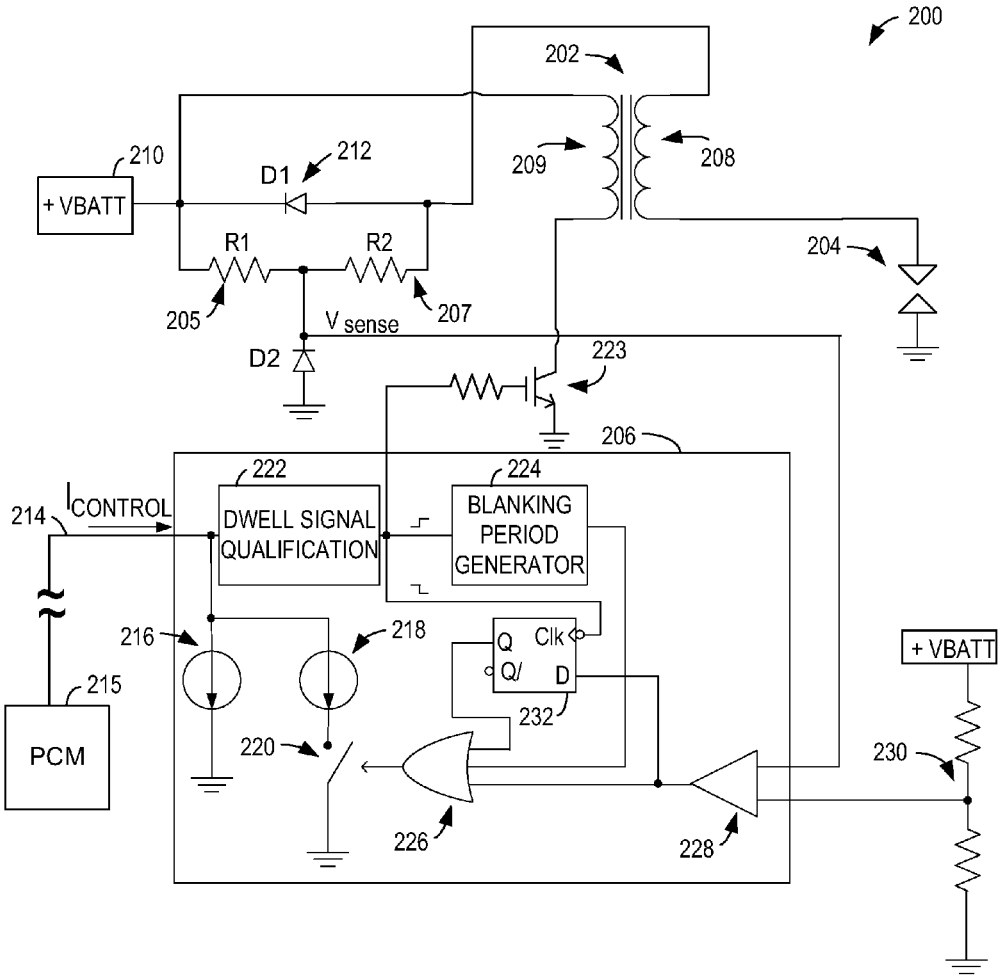
FIG. 2 shows a diagram of an ignition system in accordance with an embodiment of the present disclosure.

FIG. 2 shows an example ignition system 200 that may be included in the engine 100 of FIG. 1. The ignition system 200 includes an ignition circuit for charging an induction ignition coil 202 of a transformer to fire a spark plug 204, and the spark plug fouling and pre-ignition detecting components, resistors 205 (R1) and 207 (R2), diode 212 (D1), and dwell qualification/detection module 206 for evaluating voltage and/or current output from the ignition system in order to determine a level of spark plug fouling. The ignition circuit includes a spark plug 204 connected to a high voltage terminal of a secondary winding 208 of the ignition coil 202. The low voltage terminal of the secondary winding 208 is connected to a voltage source 210 (e.g., a voltage of a vehicle battery) via a feed-forward diode 212 (D1) connected in parallel to two resistors 205 (R1) and 207 (R2). At the beginning of ignition coil dwell, the secondary winding 208 of the ignition coil may generate approximately 1000 V peak, termed feed-forward voltage or $V_{ff}$. $V_{ff}$ slowly decays over the duration of dwell. The magnitude of the peak of $V_{ff}$ and the rate of decay depend on the characteristics of the coil and the magnitude of the battery voltage applied to the primary winding 209 of the coil. The total $V_{ff}$ is distributed between the spark plug 204 and the low voltage end of the secondary winding 208 as determined by the impedance to ground at the spark plug (e.g., the fouling impedance based on the level of spark plug fouling) and the impedance to the voltage source 210 across the feed-forward diode 212. The feed-forward diode 212 is commonly used in ignition coils to prevent bulk current flow (e.g., arcing) at the spark plug 204 at the start of dwell. The impedance across the diode is determined by the two resistors, 205 (R1) and 207 (R2), placed in series with one another and in parallel across the diode 212. By selecting values for the resistors, the signal output may be "tuned" to be effective at a selected level of plug fouling for safeguarding the engine from misfires caused by plug fouling and to reliably detect the occurrence of pre-ignition. For example, lower values of resistors will make detection less sensitive (e.g., enable relatively higher levels of fouling to be tolerated) while higher values will make detection more sensitive (e.g., enable relatively lower levels of fouling to be tolerated).

The dwell qualification and plug fouling/pre-ignition module 206 is connected to the ignition circuit by an input tap connected between the resistors 205 (R1) and 207 (R2) in order to determine the level of plug fouling based upon a rate of decay of the voltage at the location of the input tap, as described in more detail below. A control signal may be provided over a control wire 214 and utilized to start dwell of the ignition coil 202 of the ignition circuit. For example, the control signal may be provided by a Powertrain Control Module (PCM) 215. At the beginning of dwell, both current sinks 216 and 218 on the control signal are ON (e.g., switch 220 is closed). The dwell signal qualification module 222 receives the control signal and detects the beginning edge of the dwell. At the beginning edge of the dwell, the control signal is forwarded to a solid-state switching device, such as an insulated-gate bipolar transistor (IGBT) 223, which establishes and disrupts the current flow to the primary windings 209 of the ignition coil 202. The dwell signal qualification module and solid-state device may form an intelligent driver for dwell control of the ignition coils, including interpretive logic to decode or otherwise interpret the dwell commands provided for control of the ignition coils.

The dwell signal qualification module 222 may also instruct a blanking period generator 224 to generate a blanking period (e.g. with a duration of 500 μsec) which holds switch 220 closed to avoid any ringing present on the feed-forward voltage at the beginning of dwell. Accordingly, the blanking period generator may output a logic 1 for a specified time interval during the beginning of dwell. The output of the blanking period generator 224 is provided as an input to a logical OR gate 226 that controls switch 220. In particular, the logical OR gate 226 may control the switch 220 to remain closed when the output of the OR gate 226 is logic 1 (e.g., when any of the inputs to the OR gate 226 is logic 1).

The input tap described above is connected at the node between the two sensing resistors 205 (R1) and 207 (R2), and at the cathode of clamping diode 212 (D1) which will keep the input voltage not less than a diode forward voltage below ground, and that provides a sense voltage ($V_{sense}$) to a comparator 228 for comparing the sense voltage to a reference voltage at 230 (e.g., a voltage set ratio-metrically between a battery voltage and ground). The sense voltage is the inverse of the voltage appearing at the high voltage terminal of the secondary windings 208 and its magnitude is related to the ratio between the resistors 205 (R1) and 207 (R2) and the shunting impedance (e.g., the fouling level) of the spark plug 204. The comparator 228 may be configured to output logic 1 while the sense voltage is less than the reference voltage at 230 and logic 0 while the sense voltage is greater than the reference voltage.

As the logic OR gate 226 is configured to maintain the switch 220 in the closed state when the output of the gate 226 is logical 1, the switch 220 remains closed during the blanking period. After the blanking period, switch 220 is controlled by the output of a voltage comparator 228 and the state of a D flip-flop 232. The D flip-flop 232 stores and/or outputs the output of the comparator 228 at the end of each dwell (e.g., at the falling edge of a clock signal received from the dwell signal qualification module 222) and outputs the stored value at other times (e.g., at a steady state or rising edge of the clock signal). If the D flip-flop 232 stores a logic 0, switch 220 is controlled by voltage comparator 228. As the feed-forward voltage decays throughout dwell, at some point under moderate levels of fouling at the spark plug, the sense voltage will rise above the threshold level (e.g., above the reference voltage). At this point, current sink 218 is turned off (e.g., switch 220 is opened). This change of the current sink level is detected by a driver integrated circuit (IC) in the PCM 215 and the length of time interval from the beginning of dwell to the switching point (e.g., a decay time) is interpreted as a level of fouling present at the spark plug. This information is communicated to the microprocessor in the PCM 215. If the microprocessor determines that the level of fouling is too great (e.g., upon comparing the detected level of fouling to a fouling threshold or a decay time to a decay threshold) the microprocessor may warn the driver to replace the spark plugs. For example, the microprocessor may provide a visual, audio, and/or other type of indication to the driver recommending a replacement of the spark plugs.

The D flip-flop 232 may be controlled to store the state of the comparator at the trailing edge of dwell. If pre-ignition occurs, such a condition will cause the comparator output to equal logic 1 at the end of dwell (e.g., as $V_{sense}<V_{reference}$). This logic 1 is captured at the end of dwell and causes switch 220 to remain closed for the entire following dwell period. During that dwell period, the microprocessor may interpret the closed switch condition as corresponding to an occurrence of pre-ignition (PI) in the previous combustion event and output an indication to replace the spark plugs.

Figure 3:
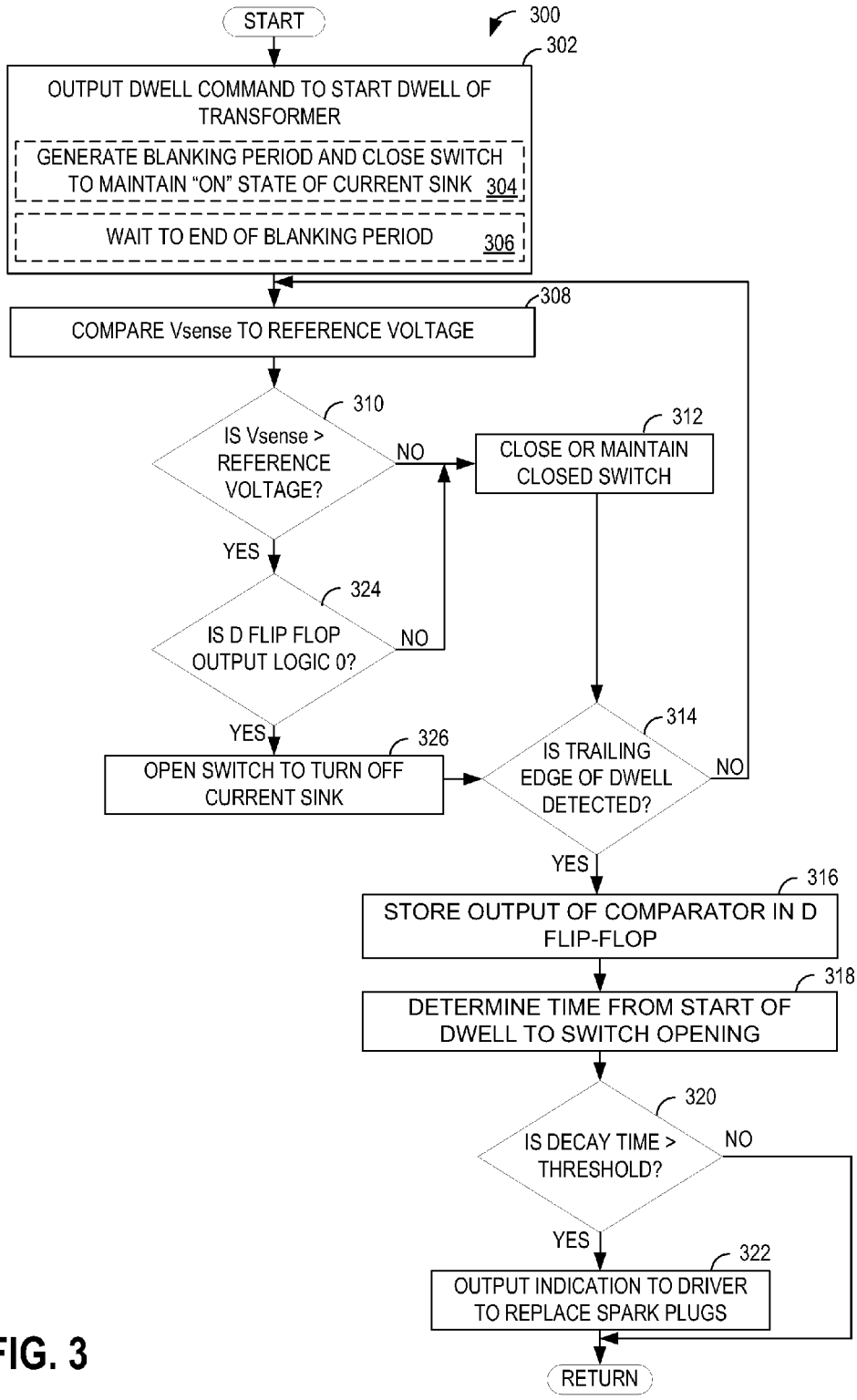
FIG. 3 is a flow diagram of a method of determining spark plug fouling and pre-ignition in accordance with an embodiment of the present disclosure.

FIG. 3 is a flow diagram of a method 300 for controlling an ignition coil and detecting spark plug fouling and/or pre-ignition in cooperation with the configuration of FIG. 2, and therefore spark generation, in an engine, such as the engine of FIG. 1. For example, the method 300 may be performed by the controller 12 of FIG. 1 and/or the PCM 215 of FIG. 2 and utilize measurements and/or outputs provided by the integrated circuits of FIG. 2. At 302, the method 300 includes outputting a dwell command to control an ignition coil, such as the ignition coil 202 of FIG. 2. For example, the dwell command may be a pulse having a particular length (e.g., a pulse that is applied for a duration that is longer than a threshold). During the commanded dwell, current is passed through the primary windings of the ignition coil to generate a magnetic field. Responsive to detecting the dwell command at a module, such as the dwell signal qualification module 222 of FIG. 2, a blanking period may be generated during which a switch is closed to maintain or set a current sink in an "ON" state, as indicated at 304.

After the blanking period ends, at 306, a voltage at a sensed location in the ignition circuit (e.g., $V_{sense}$ of FIG. 2) that has a magnitude related to the fouling level of the spark plug is compared to a reference voltage at 308. As indicated at 310, if $V_{sense}$ is less than the reference voltage (e.g., "NO" at 310), the method 300 proceeds to 312 to close or maintain a closed switch, then to 314 to determine whether the trailing edge of the dwell command signal is detected. The trailing edge of the dwell command may include a termination of the pulse to trigger an interruption and/or cessation of current flow through the primary windings of the ignition coil. The interruption of the current flow through the primary windings causes a high voltage pulse across the respective secondary windings of the ignition coil (e.g., to "fire" the spark plug and generate a spark for initiating combustion in a cylinder of the engine). If a trailing edge is not detected, (e.g., "NO" at 314), the method 300 returns to 308 continue monitoring $V_{sense}$. Conversely, if the trailing edge of the dwell command signal is detected (e.g., "YES" at 314), a D flip flop (e.g., D flip flop 232 of FIG. 2) is triggered to store the output of the comparison of $V_{sense}$ to the reference voltage, as indicated at 316. A condition, in which $V_{sense}$ is less than the reference voltage at the trailing edge of dwell, is indicative of a pre-ignition event. Since the pre-ignition event prevents the switch from being opened to turn off the current sink during the following dwell or combustion cycle, a switching time from beginning of dwell to the switching point may be determined to be approximately equal to the entire dwell time at 318. This switching time may be indicative of a pre-ignition event during the previous combustion cycle.

The method 300 then determines whether the switching time is greater than a threshold at 320. If the switching time is less than a threshold (e.g., "NO" at 320), the method 300 then returns to wait for the next dwell command. If the switching time is greater than a threshold (e.g., "YES" at 320), method 300 then proceeds to 322 to output an indication to the driver to replace the spark plugs responsive to detecting either a fouled plug or a pre-ignition event. For example, if the current on the control wire drops below a predetermined value after a threshold period of time has elapsed after the dwell command is provided, the decay time may be determined to be greater than the threshold. Conversely, if the current on the control wire drops below a predetermined value prior to a threshold period of time has elapsed after the dwell command is provided, the decay time may be determined to be less than the threshold. If the decay time is less than the threshold (e.g., "NO" at 320), the method 300 may return to await a next combustion event (e.g., without outputting an indication to replace the spark plugs). Conversely, if the decay time is greater than a threshold (e.g., "YES" at 320), the method 300 may proceed to 322 to output an indication to the driver to replace the spark plugs. For example, outputting the indication may include sending an instruction to an icon or display device on an instrument panel to display a visual indicator to the driver regarding the spark plug change recommendation. Outputting the indication may additionally or alternatively include sending an instruction to a speaker system to output an audio indicator (e.g., an audio message, a system beep, etc.) regarding the spark plug change recommendation. After outputting the indication to the driver, the method 300 returns to wait for the next start of dwell command.

Returning to 310, at which the sensed voltage is compared to a reference voltage, if $V_{sense}$ is greater than the reference voltage (e.g., "YES" at 310), the method 300 proceeds to 324 to determine whether the D flip flop is outputting a logic 0. If not, the output of the D flip flop is a logic 1, which indicates that a pre-ignition event occurred in the previous combustion cycle, as discussed above with respect to 316 and 318. Thus, the method proceeds to 312 to maintain the closed switch and the "ON" state of the current sink. If the D flip flop outputs a logic 0 at 324 (e.g., "YES" at 324), the method 300 proceeds to 326 to open the switch and turn off the current sink. By turning off the current sink, the microprocessor may detect a drop in the measured current on the control wire of the circuit (e.g., by receiving a measurement from a current sensor coupled to the control wire) and measure the switching time from the beginning of dwell to the current sink switching point (e.g., the time at which the current sink is switched from the "ON" state to the "OFF" state). The method may then proceed to 314 to determine if the trailing edge of dwell has occurred.

Exact selection of circuit components for resistors 205 (R1) and 207 (R2) of FIG. 2, the threshold voltage 230 of FIG. 2, and the switching time threshold may be based upon attributes of the ignition coil and the range of spark plug fouling deemed unacceptable. For example, 50M ohms or 10M ohms of shunting (fouling) impedance at the spark plug may be deemed unacceptable in some embodiments. This range may be judged to give adequate warning of plug fouling prior to misfires occurring. Selection of the blanking period duration (e.g., 500 μsec) may depend on the turn-on characteristics and the total nominal dwell time of the ignition coil. Similarly, selection of the switching time threshold, as evaluated in 320, may be determined based upon the duration of the blanking period and the total nominal dwell time of the ignition coil. For example, if the blanking period is 500 μsec and the nominal dwell time is 2000 μsec, resistors 205 and 207 (R1 and R2) and the threshold voltage 230 of FIG. 2 may be chosen to yield a switching time threshold of 1250 μsec at the desired plug fouling level.

Figure 4:
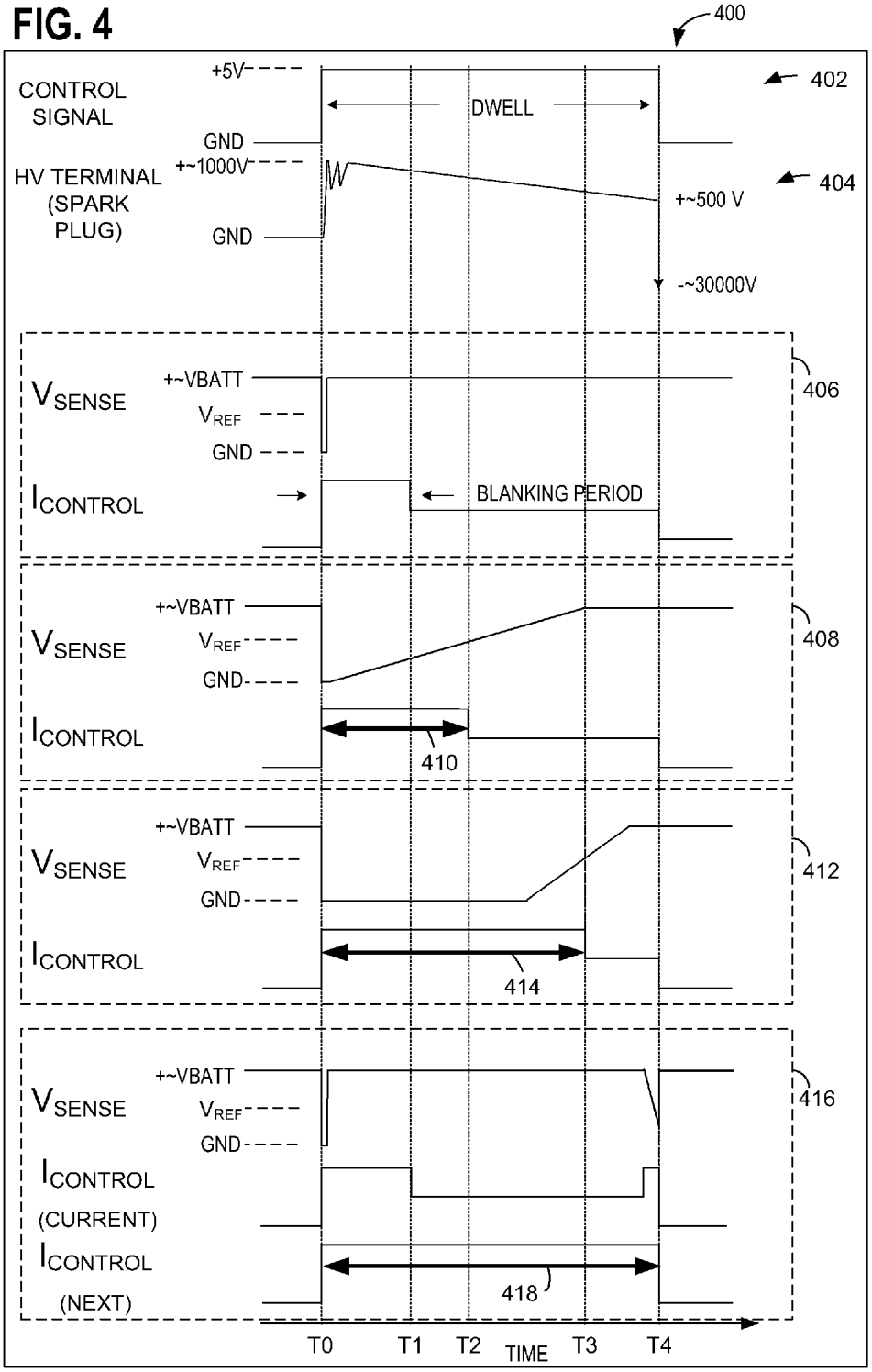
FIG. 4 shows waveforms of the operation of the ignition system responsive to a dwell command under various conditions in accordance with embodiments of the present disclosure.

FIG. 4 illustrates waveforms 400 reflecting the operation of the ignition system described herein responsive to a dwell command. In the illustrated waveforms, the x-axes correspond to a shared timeline, while each y-axis corresponds to the parameter indicated adjacent to the associated waveform. In FIG. 4, waveforms 400 show operation of the ignition system responsive to the dwelling and firing the ignition coil (e.g., ignition coil 202 of FIG. 2) under various spark plug fouling conditions.

Waveform 402 corresponds to a dwell command, which may be issued from a controller, such as controller 12 of FIG. 1. As indicated, the dwell signal has a duration extending from time T0 to time T4. Waveform 404 corresponds to a voltage at the high voltage terminal of the secondary windings of an ignition coil (e.g., secondary windings 208 of FIG. 2), which connected to the spark plug. As indicated, the voltage may decay from a peak level (e.g., approximately 1000 volts) responsive to a level of fouling on the spark plug. Upon termination of the dwell command at time T4, the current provided to the primary windings of the ignition coil may be interrupted, producing a pulse of approximately −30000 volts to be provided to the spark plug for generating a spark.

Waveform 406 corresponds to a sensed voltage (e.g., $V_{sense}$ as illustrated in FIG. 2) and current on a control wire (e.g., control wire 214 of FIG. 2) measured responsive to the dwell command of waveform 402 during ideal conditions, in which there is no pre-ignition event or spark plug fouling. As illustrated, the sensed voltage remains approximately equivalent to the battery source voltage throughout the measurement period (e.g., without dropping and/or ramping up to the battery voltage responsive to the dwell command). The current on the control wire ($I_{control}$) reflects the operation of current sinks coupled to the control wire (e.g., current sinks 216 and 218 of FIG. 2). The time between T0 and T1 corresponds to a blanking period, as described at 304 of method 300 illustrated in FIG. 3. During the blanking period, which begins at the rising edge of the dwell command and ends after a predetermined amount of time has elapsed since the start of the dwell command, both current sinks are maintained in an "ON" state, as a switch controlling the second current sink is closed.

After the blanking period ends at time T1, $V_{sense}$ is measured and compared to a reference voltage (e.g., as described at 310 of FIG. 3). As illustrated in FIG. 2, the reference voltage may be smaller than the battery voltage, and one example value of a reference voltage is indicated on the y-axis of the waveforms of FIG. 4. Since the sensed voltage is greater than the reference voltage at time T1 (e.g., when the blanking period ends), the switch is opened, turning the second current sink off (e.g., in response to the execution of 326 as illustrated in FIG. 3). The switching time may therefore be determined to be equal to the blanking period, if measured from the start of the dwell command to the time at which the second current sink is switched off (e.g., time T1). It is to be understood that the waveform 406 provides the control current during a condition in which pre-ignition was not detected during the previous combustion cycle (e.g., the sensed voltage was greater than the reference voltage at the trailing edge of the dwell command for the previous combustion cycle). At time T4, the current drops again responsive to the cessation of the dwell command, which results in a decrease in current provided to the control wire and a decrease in current at the first current sink.

Waveform 408 corresponds to a sensed voltage (e.g., $V_{sense}$ as illustrated in FIG. 2) and current on a control wire (e.g., control wire 214 of FIG. 2) measured responsive to the dwell command of waveform 402 during a condition in which there is no previous or current pre-ignition event, however a relatively moderate amount of spark plug fouling is present. As illustrated, the sensed voltage drops at the beginning of dwell due to the impedance at the spark plug caused by the fouling. As the fouling during the condition described in waveform 408 is relatively moderate, the sensed voltage may quickly ramp up to the battery voltage, surpassing the reference voltage at time T2. The current on the control wire ($I_{control}$) reflects the operation of current sinks coupled to the control wire (e.g., current sinks 216 and 218 of FIG. 2). As the sensed voltage does not exceed the reference voltage until time T2, both current sinks remain on and the current is maintained at a peak level until time T2 (at which point, the second current sink is turned off and the current drops). Thus, the switching time 410 under the moderate fouling may correspond to the amount of time that elapses between time T0 and time T2. As described above, at time T4, the current may drop (e.g., no current may flow on the control wire) responsive to the cessation of the dwell command.

Waveform 412 corresponds to a sensed voltage (e.g., $V_{sense}$ as illustrated in FIG. 2) and current on a control wire (e.g., control wire 214 of FIG. 2) measured responsive to the dwell command of waveform 402 during a condition in which there is no previous or current pre-ignition event, however a relatively high amount of spark plug fouling is present (e.g., the spark plug is more fouled than the condition represented by waveform 408). As illustrated, the sensed voltage drops at the beginning of dwell due to the impedance at the spark plug caused by the fouling. As the fouling during the condition described in waveform 408 is relatively high, the sensed voltage may stay at ground for longer than conditions in which the spark plug is more moderately fouled, and ramp up to surpass the reference voltage at time T3. The current on the control wire ($I_{control}$) reflects the operation of current sinks coupled to the control wire (e.g., current sinks 216 and 218 of FIG. 2). As the sensed voltage does not exceed the reference voltage until time T3, both current sinks remain on and the current is maintained at a peak level until time T3 (at which point, the second current sink is turned off and the current drops). Thus, the switching time 414 under the high level of fouling may correspond to the amount of time that elapses between time T0 and time T3. The switching time 414 is longer than the switching time 410 since the level of fouling is higher during the condition represented by waveform 412 in comparison with the condition represented by waveform 408. For example, the switching time 414 may be determined to be longer than the switching threshold (e.g., resulting in a "YES" at 320 of FIG. 3) while switching time 410 may be determined to be shorter than the switching threshold (e.g., an acceptable level of fouling, resulting in a "NO" at 320 of FIG. 3). Accordingly, the switching time 414 may result in an output of an indication to the driver to replace the spark plugs, while the switching time 410 may result in no such indication. As described above, at time T4, the current may drop (e.g., no current may flow on the control wire) responsive to the cessation of the dwell command.

Waveform 416 corresponds to a sensed voltage (e.g., $V_{sense}$ as illustrated in FIG. 2) and current on a control wire (e.g., control wire 214 of FIG. 2) measured responsive to the dwell command of waveform 402 during a condition in which pre-ignition event occurs. In particular, the sensed voltage corresponds to sensed voltage during a pre-ignition event, and the current on the control wire corresponds to the measured current during the next combustion cycle directly following the pre-ignition event (e.g., pre-ignition has occurred before the trailing edge of dwell in previous combustion cycle). As illustrated, the sensed voltage remains at the battery voltage level until just prior to the trailing edge of the dwell command at T4, at which point the voltage drops to below the reference voltage level. Shown below the sensed voltage are the current on the control wire for the current dwell cycle and the current on the control wire for the next consecutive dwell cycle. The current on the control wire ($I_{control}$) reflects the operation of current sinks coupled to the control wire (e.g., current sinks 216 and 218 of FIG. 2). During the current dwell cycle, the current drops to the lower level at T1, as expected with no fouling present. Just prior to the end of dwell however, the current jumps to the higher level due to Vsense being less than the reference voltage (resulting in a "NO" at 310 of FIG. 3). At the end of dwell, T4, the D flip-flop captures the pre-ignition event and holds the current on the control wire at the high level through the entire following dwell period as illustrated by $I_{control}$ (next consecutive dwell cycle). Thus, the switching time 418 responsive to the pre-ignition event may correspond to the amount of time that elapses between time T0 and time T4. The switching time 418 is longer than the switching times 410 and 414 due to the pre-ignition event and is reported at the combustion cycle following the pre-ignition event. Accordingly, during the reporting combustion cycle, the switching time may be determined to be above a switching threshold and an indication to change the spark plugs may be output (e.g., via a display or other visual indicator of the vehicle). As described above, at time T4, the current may drop (e.g., no current may flow on the control wire) responsive to the cessation of the dwell command.

The above-described ignition systems and routines thereby provide a mechanism for detecting spark plug fouling and pre-ignition events. Accordingly, spark plug change recommendations may be provided based on evidence of malfunction or degradation, rather than a predetermined period of time or amount of vehicle usage (e.g., recorded operational mileage, number of combustion cycles, etc.). Such recommendations may ensure that spark plug change recommendations are provided in a timely manner, rather than too soon (e.g., resulting in increased cost for the driver) or too late (e.g., resulting in damage to the vehicle). Further, by determining the level of spark fouling at a controller based upon a measurement of current on a control wire, the condition may be detected without an additional wire (e.g., other than the control wire for providing dwell commands) from each ignition coil to the controller.

Note that the example control and measurement routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

outputting a dwell command on a control wire to start dwell of an ignition coil;

comparing a sensed voltage at a low voltage terminal of a secondary winding of the ignition coil to a reference voltage;

opening a switch to turn a current sink off responsive to determining that the sensed voltage is greater than the reference voltage, the current sink being connected to the control wire;

determining a switching time from a beginning of the dwell command to a switching point, the switching point being the time at which the switch is opened;

comparing the switching time to a threshold; and outputting an indication of a recommendation to change one or more spark plugs responsive to determining that the switching time is greater than the threshold.

2. The method of claim 1, further comprising determining if a trailing edge of the dwell command is detected responsive to determining that the sensed voltage is less than the reference voltage.

3. The method of claim 2, further comprising storing a logic 1 at a D flip flop responsive to detecting a trailing edge of the dwell command while the sensed voltage is less than the reference voltage.

4. The method of claim 3, further comprising closing the switch while the output of a D flip flop is logic 1.

5. The method of claim 4, further comprising reporting the closed switching during the next combustion cycle.

6. The method of claim 1, further comprising storing a logic 0 at a D flip flop responsive to detecting a trailing edge of the dwell command while the sensed voltage is greater than the reference voltage.

7. The method of claim 1, wherein outputting the indication of the recommendation to change one or more spark plugs comprises outputting a visual indication of the recommendation.

8. The method of claim 1, wherein outputting the indication of the recommendation to change one or more spark plugs comprises outputting an audible indication of the recommendation.

* * * * *